US012687001B2

(12) United States Patent
Benesh et al.

(10) Patent No.: US 12,687,001 B2
(45) Date of Patent: Jul. 21, 2026

(54) TRAP SEAL PROTECTION DEVICE

(71) Applicant: Zurn Water, LLC, Milwaukee, WI (US)

(72) Inventors: Michael T. Benesh, Erie, PA (US); Christopher J. Say, Erie, PA (US); Glen W. Trickle, Elm Grove, WI (US); Zach Cronin, Erie, PA (US); Seth R. Wenzel, Mckean, PA (US); Balaji Chandran, Erie, PA (US)

(73) Assignee: Zurn Water, LLC, Milwaukee, WI (US)

( * ) Notice: Subject to any disclaimer, the term of this patent is extended or adjusted under 35 U.S.C. 154(b) by 62 days.

(21) Appl. No.: 18/634,375

(22) Filed: Apr. 12, 2024

(65) Prior Publication Data

US 2024/0344309 A1 Oct. 17, 2024

Related U.S. Application Data

(60) Provisional application No. 63/495,988, filed on Apr. 13, 2023.

(51) Int. Cl.
*E03C 1/29* (2006.01)

(52) U.S. Cl.
CPC ..... *E03C 1/29* (2013.01)

(58) Field of Classification Search
CPC ..... E03C 1/29; E03C 1/288; F16K 15/148
USPC ..... 4/695; 285/46, 64
See application file for complete search history.

(56) References Cited

U.S. PATENT DOCUMENTS 6,598,352 B2 * 7/2003 Higginbotham ..... E04D 13/076 52/12
8,622,090 B2 1/2014 Larkin et al.

FOREIGN PATENT DOCUMENTS

| | | | | |
|---|---|---|---|---|
| AU | 2005335564 A1 | | 2/2007 | |
| AU | 2008243269 B1 | | 4/2009 | |
| AU | 2010246053 A1 | * | 12/2011 | ..... E03C 1/298 |
| AU | 2011293077 A1 | | 4/2013 | |
| CN | 2632168 Y | | 8/2004 | |
| CN | 1594769 A | | 3/2005 | |
| CN | 1318705 C | | 5/2007 | |
| CN | 114076237 A | * | 2/2022 | ..... E03C 1/122 |
| DE | 202022100495 U1 | * | 2/2022 | ..... E03C 1/288 |
| EP | 2356290 A1 | | 8/2011 | |
| HK | 1160496 A1 | | 8/2012 | |

(Continued)

OTHER PUBLICATIONS

Combined Search and Examination Report for Application No. GB2405248.2, dated Oct. 14, 2024, 4 pages.

*Primary Examiner* — Lori L Baker
(74) *Attorney, Agent, or Firm* — Husch Blackwell LLP

(57) ABSTRACT

A trap seal protection device may provide an evaporation barrier for a drain and reduce odors and gases emitting from the drain. The trap seal protection device includes a housing including a flange engaging a radial surface of a drain assembly to support the housing relative to the drain assembly, a gasket coupled to the housing, the gasket having an outer diameter engaging an inner diameter of the drain assembly, a seal member positioned within the housing and selectively forming a seal against the housing. The seal member is movable to permit fluid flow through the trap seal protection device, wherein an axial distance between the flange and the seal member is greater than the outer diameter of the gasket.

22 Claims, 12 Drawing Sheets

(56) References Cited

FOREIGN PATENT DOCUMENTS

| | | | |
|---|---|---|---|
| KR | 1020050088972 | A | 9/2005 |
| KR | 100684937 | B1 | 2/2007 |
| KR | 1020110015952 | A | 2/2011 |
| KR | 101299660 | B1 | 8/2013 |
| WO | 2006005244 | A1 | 1/2006 |
| WO | 2007021049 | A1 | 2/2007 |
| WO | 2010057248 | A1 | 5/2010 |
| WO | 2012024716 | A1 | 3/2012 |

* cited by examiner

TRAP SEAL PROTECTION DEVICE

CROSS-REFERENCE TO RELATED APPLICATION

This application claims the benefit of U.S. Provisional Patent Application No. 63/495,988 filed Apr. 13, 2023, the entire contents of which is incorporated by reference herein.

TECHNICAL FIELD

The present application relates to assemblies for a drain such as a floor drain, a shower drain, a tub drain, or the like, and, more particularly, to a trap seal protection device for a drain.

BACKGROUND

Trap seal protection devices reduce trap evaporation and reduce odors emitting from drain assemblies.

SUMMARY

In one independent aspect, a trap seal protection device is provided for a drain assembly having a drain body. The trap seal protection device includes a housing including a flange configured to engage a surface of the drain assembly to support the housing relative to the drain assembly, a gasket supported by the housing, the gasket having an outer diameter and configured to engage an inner surface of the drain body, and a seal member supported by the housing and selectively sealing a fluid passageway, the seal member being selectively movable to permit fluid to flow past the seal member, an axial distance between the flange and the seal member being greater than the outer diameter of the gasket.

In some aspects, the gasket includes a protrusion that extends radially inwardly from an upper surface of the gasket, and the protrusion engages the housing and prevents movement of the gasket relative to the housing.

In some aspects, an outer surface of the housing includes a protrusion engaging a portion of the gasket, engagement of the gasket by the protrusion preventing movement of the gasket relative to the housing.

In some aspects, the gasket includes a gasket protrusion that extends radially inwardly from an upper surface of the gasket, and the housing includes a first housing protrusion and a second housing protrusion, each of the first housing protrusion extending radially outwardly from an outer surface of the housing, the gasket protrusion positioned between the first housing protrusion and the second housing protrusion.

In some aspects, the gasket protrusion abuts the first housing protrusion and the second housing protrusion to prevent movement of the gasket relative to the housing.

In some aspects, an upper portion of the housing is positioned upstream of the seal member in a direction of fluid flow through the drain assembly.

In some aspects, the housing includes a first outer wing and a second outer wing, the first outer wing and the second outer wing spaced apart from one another by an open space.

In some aspects, a lower portion of the housing has a tapered outer surface, and an upper portion of the housing has a substantially consistent outer width along a longitudinal axis of the housing.

In some aspects, the trap seal protection device includes a post that extends in an axial direction from an upper end of the housing to a lower end of the housing, the post including a hollow tube portion extending an entire length of the post to provide a vent path from the lower end of the housing to the upper end of the housing, and a cap coupled to an upper end of the post to prevent fluids from entering the hollow tube portion while allowing air to escape the hollow tube portion at the upper end of the post.

In another independent aspect, a trap seal protection device for a drain assembly includes a housing including a downstream portion and an upstream portion, the upstream portion including a plurality of wings, each one of the wings including a distal end and a bearing surface positioned adjacent the distal end, the bearing surface protruding radially outward from the housing and configured to engage a surface of the drain assembly, and a gasket supported by the housing, the gasket configured to engage an inner surface of the drain assembly In some aspects, the trap seal protection device includes a post that extends in an axial direction from an upper end of the housing to a lower end of the housing. A rib extends radially between the central post and at least one of the wings.

In some aspects, the trap seal protection device includes a seal member engaging and providing a water-tight seal between an outer surface of the post and an inner surface of the housing.

In some aspects, the post includes a hollow tube portion extending an entire length of the post to provide a vent path from the lower end of the housing to the upper end of the housing.

In some aspects, the hollow tube portion has a diameter that increases as the hollow tube portion extends from a lower end of the post to an upper end of the post.

In some aspects, the trap seal protection device includes a seal member supported by the housing and selectively sealing a fluid passageway, the seal member being selectively movable to permit fluid to flow past the seal member, an axial distance between the upper end of the housing and the seal member being greater than an outer diameter of the gasket.

In some aspects, the trap seal protection device includes a cap coupled to an upper end of the post to prevent fluids from entering the hollow tube portion while allowing air to escape the hollow tube portion at the upper end of the post.

In some aspects, the gasket includes a protrusion that extends radially inwardly from an upper surface of the gasket, the protrusion engaging the housing and preventing movement of the gasket relative to the housing.

In yet another independent aspect, a drain assembly includes, a main body, a grate supported relative to the main body and covering an inlet, a radial surface extending from an upper end of the main body, the radial surface positioned less than two inches below the grate, and a trap seal protection device. The trap seal protection device includes a housing including a flange engaging the radial surface to support the housing relative to the main body, a gasket coupled to the housing, the gasket having an outer diameter engaging an inner surface of the main body, and a seal member supported by the housing and selectively sealing a fluid passageway, the seal member being selectively movable to permit fluid to flow past the seal member.

In some aspects, an axial distance between the flange and the seal member is greater than the outer diameter of the gasket.

In some aspects, an upper end of the seal member is positioned at least 4 inches below the grate.

In some aspects, the main body has a substantially cylindrical shape, the main body having a diameter that is substantially equal to a pipe diameter of a wastewater pipe coupled to a downstream end of the drain assembly.

In some aspects, the drain assembly includes a post that extends in an axial direction from an upper end of the housing to a lower end of the housing, the post including a hollow tube portion extending an entire length of the post to provide a vent path from the lower end of the housing to the upper end of the housing, and a cap coupled to an upper end of the post to prevent fluids from entering the hollow tube portion while allowing air to escape the hollow tube portion at the upper end of the post.

DETAILED DESCRIPTION

Before any embodiments are explained in detail, it is to be understood that the disclosure is not limited in its application to the details of the configuration and arrangement of components set forth in the following description or illustrated in the accompanying drawings. The disclosure is capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof, as well as possible additional items. Unless specified or limited otherwise, the terms "mounted," "connected," "supported," and "coupled" and variations thereof are used broadly and encompass both direct and indirect mountings, connections, supports, and couplings.

Relative terminology, such as, for example, "about," "approximately," "substantially," etc., used in connection with a quantity or condition would be understood by those of ordinary skill to be inclusive of the stated value and has the meaning dictated by the context (e.g., the term includes at least the degree of error associated with the measurement accuracy, tolerances [e.g., manufacturing, assembly, use, etc.] associated with the particular value, etc.). Such terminology should also be considered as disclosing the range defined by the absolute values of the two endpoints. For example, the expression "from about 2 to about 4" also discloses the range "from 2 to 4." The relative terminology may refer to plus or minus a percentage (e.g., 1%, 5%, 10%, or more) of an indicated value.

A waterless trap is typically used in conjunction with a P-trap to form a seal above the liquid in the P-trap to inhibit evaporation of the liquid, maintain the liquid barrier in the P-trap for a longer period of time, and inhibit gas from an attached drain or sewer line from passing upwardly through the drain opening. The waterless trap may still permit a flow of water downwardly into the P-trap.

Figure 2:
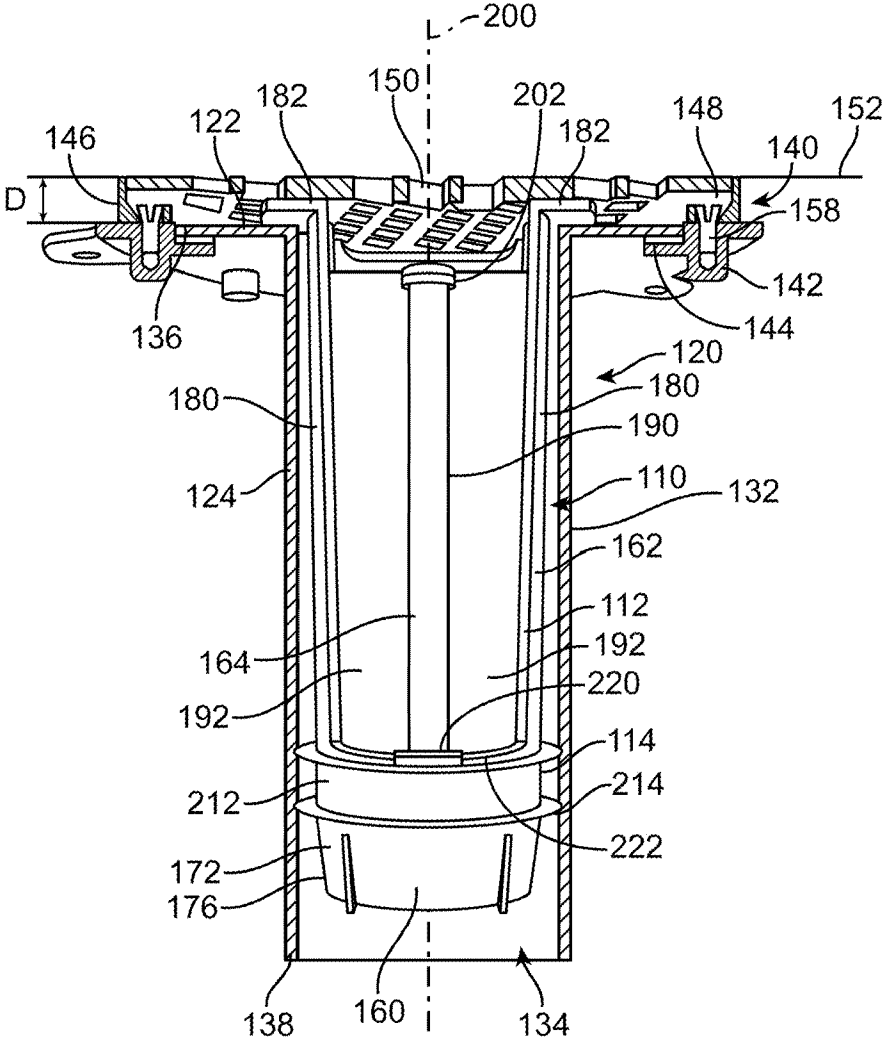
FIG. 2 is a section view of the drain assembly of FIG. 1 with a trap seal protection device positioned within the drain assembly.
Figure 1:
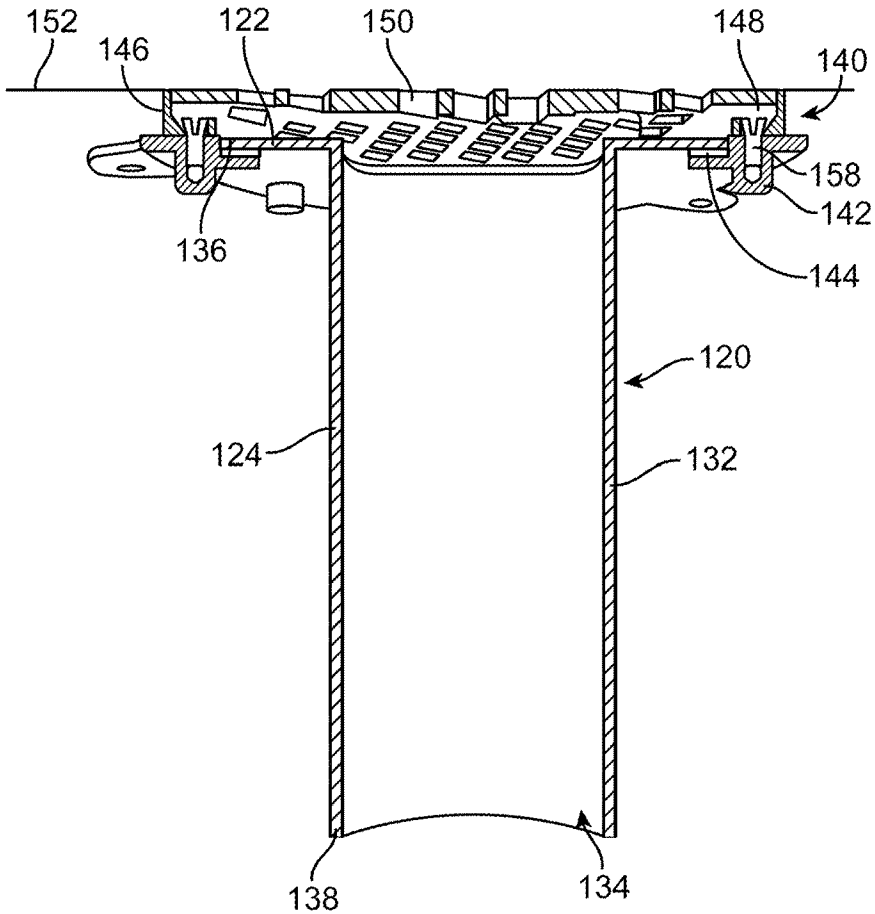
FIG. 1 is a section view of a drain assembly.

FIG. 1 illustrates a drain assembly 120 provided without a trap seal protection device 110, while FIG. 2 illustrates a trap seal protection device 110 positioned within the drain assembly 120. In the illustrated embodiment, the drain assembly 120 is a shallow drain assembly that, for example, is incorporated in an offsite pod/prefab construction, an elevator trench drain, or another drain having a low profile. The drain assembly 120 includes a drain body 132, a flange 122, and a cylindrical portion 124 extending downwardly from the flange 122. The flange 122 extends radially outward from the cylindrical portion 124 and is located at a frame receiving end 136 of the drain body 132. The cylindrical portion 124 extends from the flange 122 to a pipe receiving end 138. A frame assembly 140 is coupled to the flange 122 as is, for example, mounted to an upper side or an underside of the flange 122. The frame assembly 140 shown includes a first frame member 142 formed as an annular frame member. A gasket 144 is positioned between the flange 122 and the first frame member 142 to provide a watertight seal therebetween. In the illustrated embodiment, a second frame member 146 is mounted to the first frame member 142 (e.g., via threaded fasteners 158) and includes a grate receiving end 148 upon which a grate 150 is mounted. The top surface of the grate 150 is located generally at an elevation (i.e., height) of a finished floor 152 such that the remainder of the drain assembly 120 is located below the height of the finished floor 152.

A body cavity 134 is positioned within the cylindrical portion 124. The body cavity 134 has a width substantially equal to the diameters of the pipe receiving end 138, the drain pipe affixed thereto, and the trap seal protection device 110 positioned therein. As such, the drain body 132 lacks any planar surface perpendicular to the axis of the cylindrical portion 124 at a height below the flange 122. The effective depth D at which the flange 122 is positioned relative to the finished floor 152 or an upper surface of the grate 150 (i.e., sump depth) is only roughly ½ inch (e.g., between ⅛ inch and one inch). The drain assembly 120 therefore lacks a mounting location for, and cannot otherwise accommodate, existing trap seal protection devices that have a larger sump depth and/or a body with a width (or diameter) substantially larger than the diameter of the pipe receiving end 138.

The trap seal protection device 110 is illustrated in FIGS. 2-5 and 7-15 and includes a housing 112, a gasket 114, and a seal member 116. The housing 112 includes a downstream portion or lower portion 160, an upstream portion or upper portion 162, and an intermediate portion or central portion 164. The lower portion 160 is generally cylindrical and annular, having an inner surface defining a fluid flow passage 166 (e.g., see FIGS. 8-11) therethrough. Water and other fluids passing through the grate 150 and into the drain assembly 120 are directed through the fluid flow passage 166 and out of the housing 112 via an opening 168 adjacent a lower axial end 170 of the housing 112. A gasket receiving surface 174 (FIGS. 8-11) is positioned on an outer surface 172 of the lower portion 160 for coupling to the gasket 114. The gasket receiving surface 174 is generally cylindrical. In some embodiments, the gasket receiving surface may include axially-extending ribs (e.g., four ribs, although it may include fewer or more ribs) that protrude outward to assist in installation of the gasket 114 onto the gasket receiving surface. A tapered outer surface 176 extends axially from the gasket receiving surface 174 and tapers radially inwardly from the gasket receiving surface 174 towards the lower axial end 170 of the housing 112. The tapered outer surface 176 assists in installation of the gasket 114 onto the gasket receiving surface 174 and further assists in installation of the trap seal protection device 110 within the drain assembly 120.

The upper portion 162 of the housing 112 is coupled to (e.g., integrally formed with) the lower portion 160 of the housing 112 and extends axially upward away from the lower portion 160. In the illustrated embodiment, the upper portion 162 includes wings 180 extending axially away from the lower portion 160. The wings 180 may be diametrically opposed to one another, coupled to opposing sides of the lower portion 160. Each wing 180 is continuous with the lower portion 160 such that the gasket receiving surface 174 transitions into the wings 180 where the lower portion 160 meets the upper portion 162. Each wing 180 terminates at a flange 182 that extends radially outward from an upper end of the respective wing 180. The flanges 182 may include a bearing surface (e.g., a lower surface) that can rest upon the flange 122 of the drain assembly 120, as illustrated in FIG. 2.

Figure 7A:
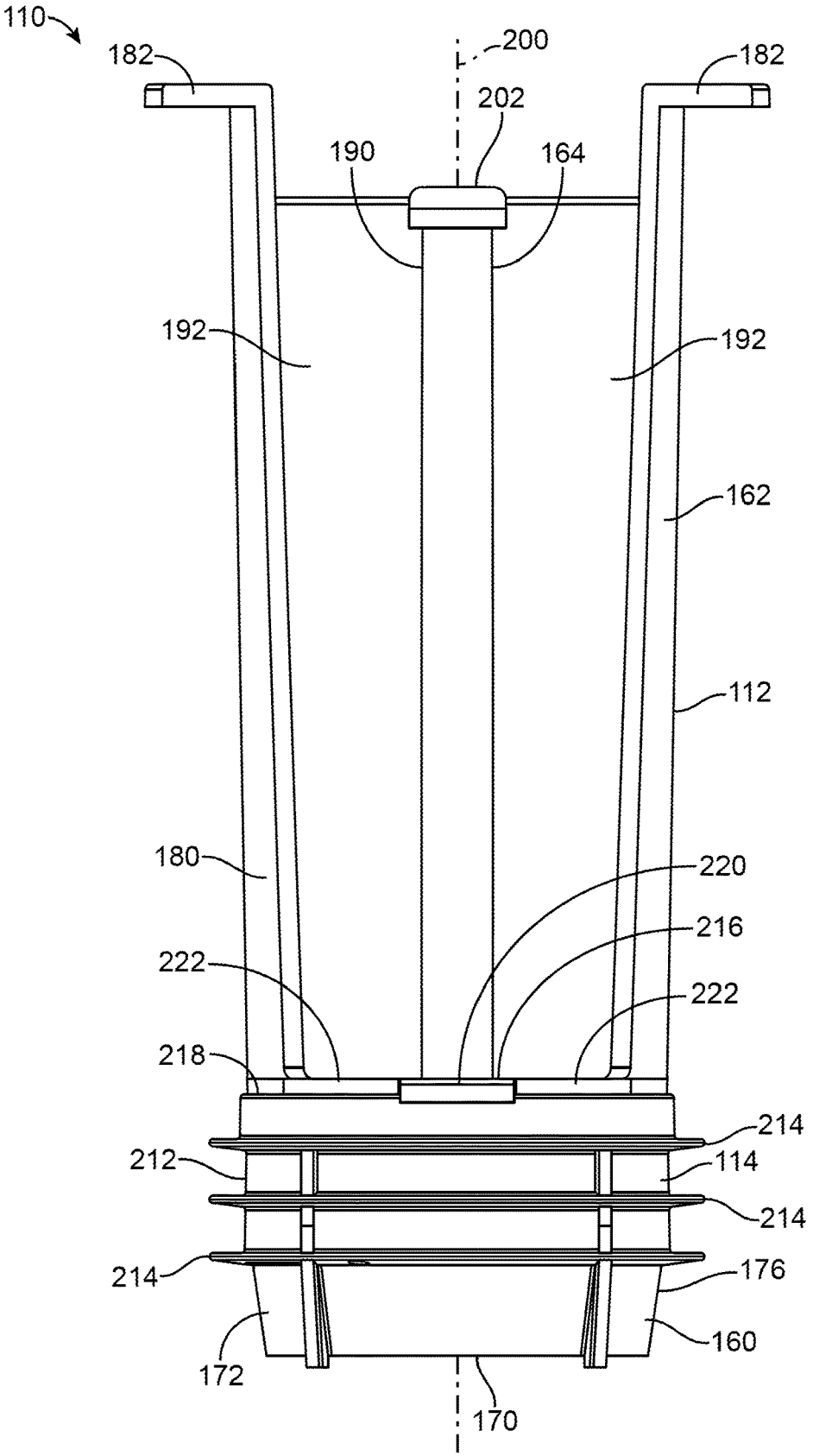
FIG. 7A is a front view of the trap seal protection device of FIG. 2.
Figure 7B:
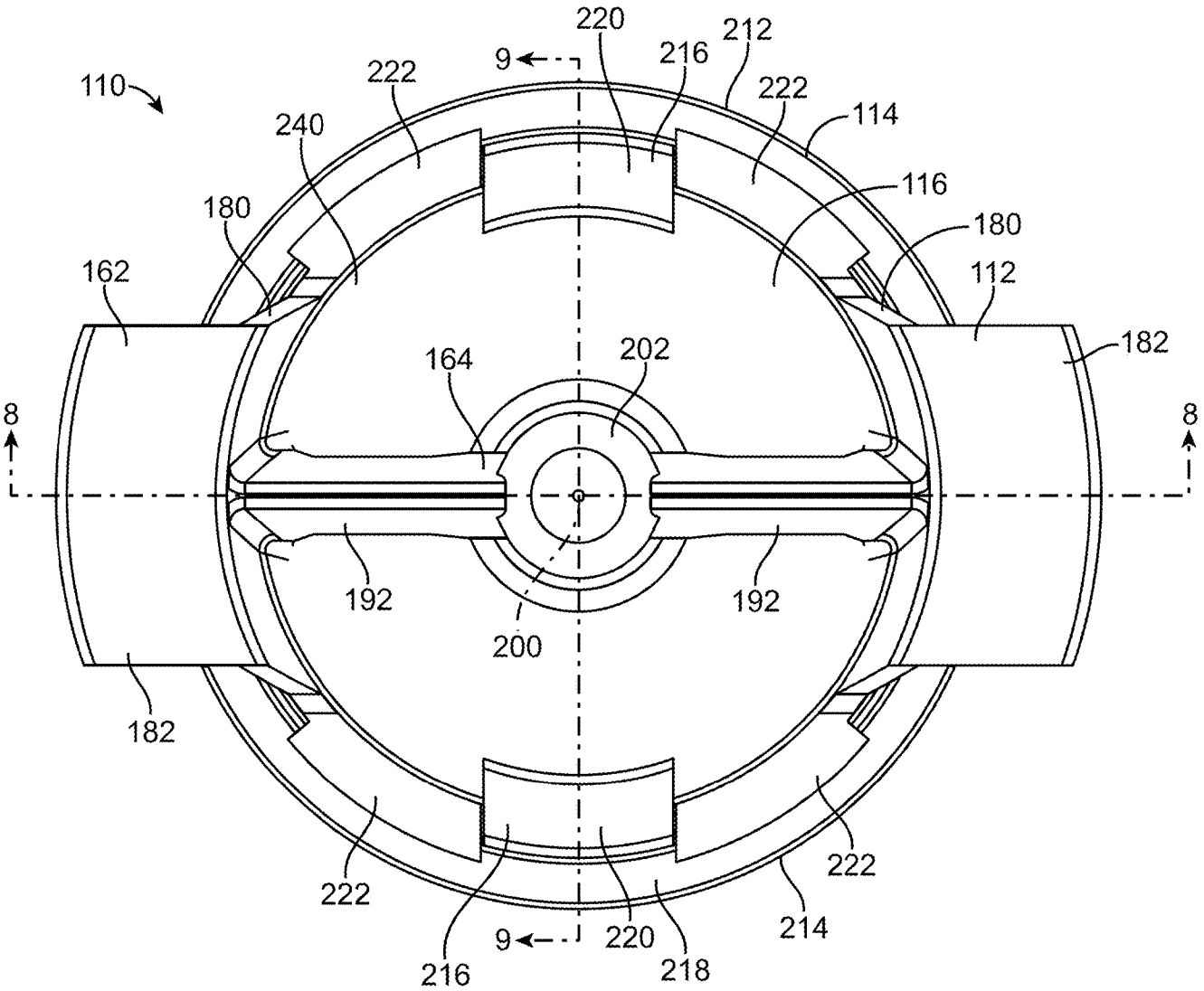
FIG. 7B is a top view of the trap seal protection device of FIG. 2.

The wings 180 are discrete and separate from one another. In the embodiment shown, the upper portion 162 includes two wings 180, though in other embodiments additional (e.g., three, four, five, six) wings may be provided. As shown in FIG. 7B, each wing 180 corresponds to less than a quarter of the circumference of the lower portion 160 such that no portion of the upper portion 162 is located above over half of the circumference of the lower portion 160. A cross-section taken perpendicular to the central axis 200 of the trap seal protection device 110 along the upper portion 162 illustrates two distinct and separate wings 180 that are disconnected from one another except via the central portion 164.

The central portion 164 is located radially inward of the lower portion 160 and the upper portion 162. The central portion 164 includes a hollow central post 190 and first and second ribs 192 connecting the central post 190 to the lower and upper portions 160, 162. The hollow central post 190 is a hollow tube extending axially along a majority of the axial length (i.e., height) of the trap seal protection device 110. The hollow central post 190 provides venting of air/gasses within the drain pipe when fluids pass through the trap seal protection device 110.

Figure 9:
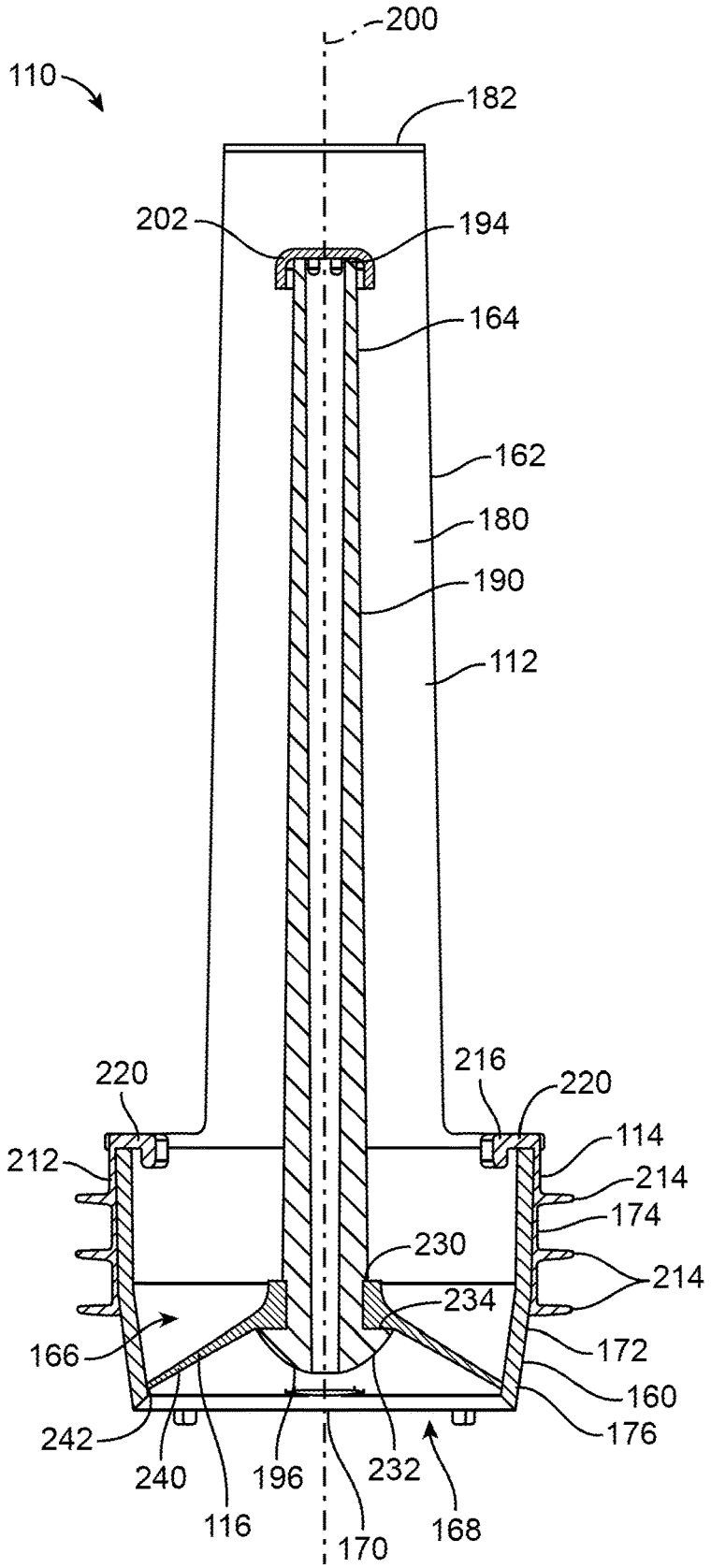
FIG. 9 is a second cross-sectional view of the trap seal protection device of FIG. 2 viewed along section 9-9 as indicated in FIG. 7B.
Figure 10:
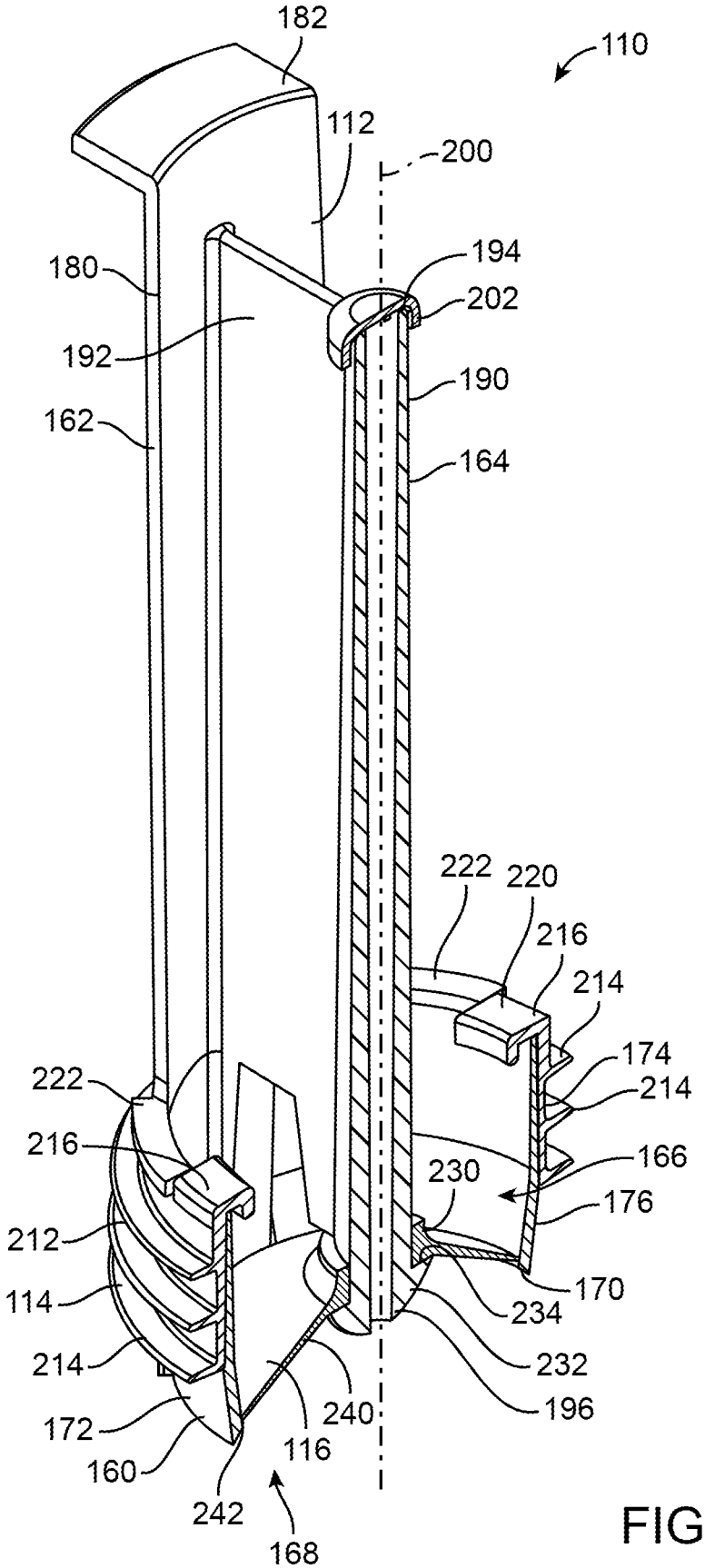
FIG. 10 is a perspective view of the cross-section shown in FIG. 9.
Figure 11:
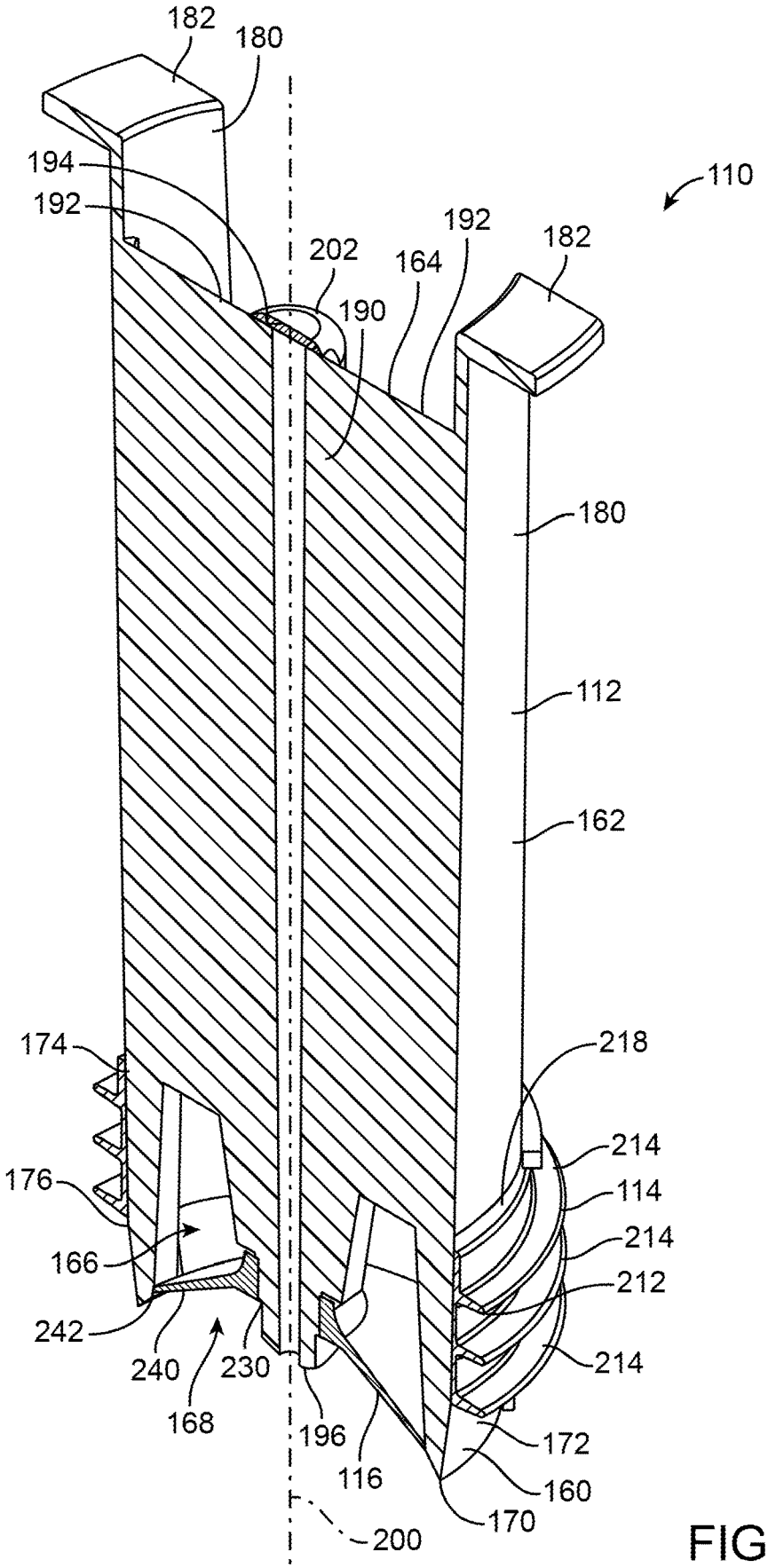
FIG. 11 is a perspective view of the cross-section shown in FIG. 8.
Figure 12:
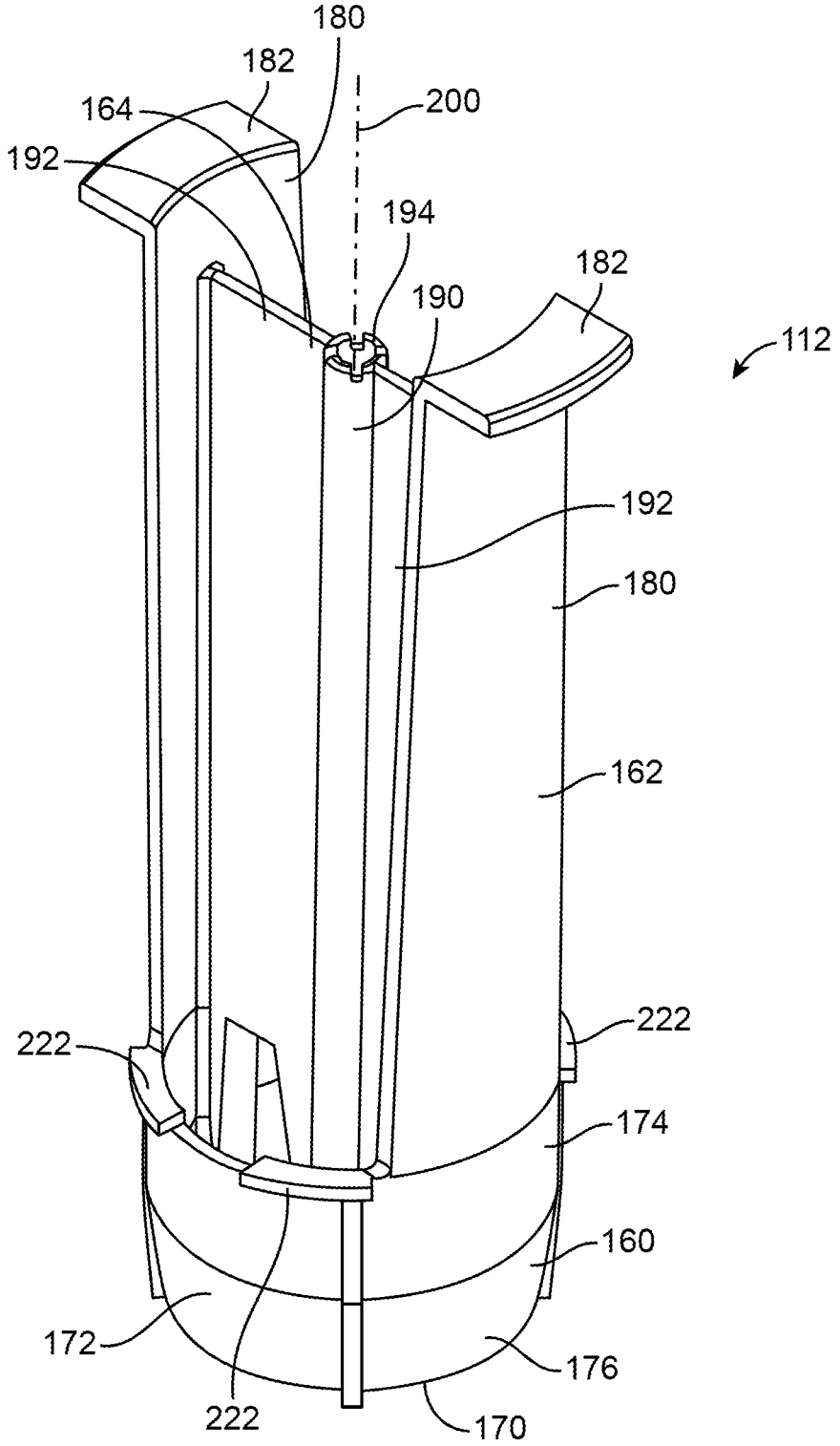
FIG. 12 is a perspective view of a housing.
Figure 13:
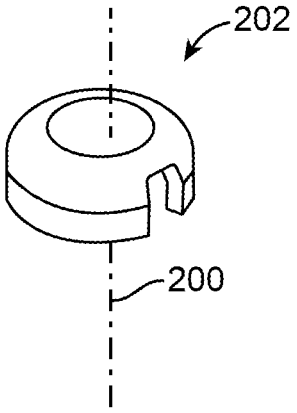
FIG. 13 is a perspective view of a cap.
Figure 15:
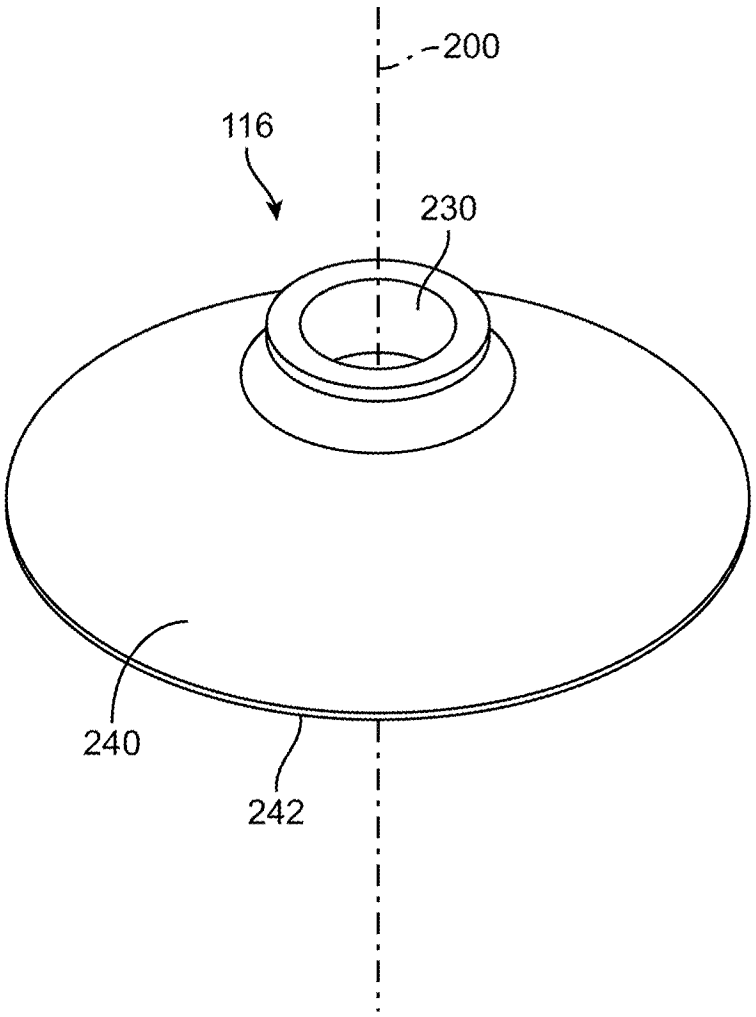
FIG. 15 is a perspective view of a seal member.
Figure 14:
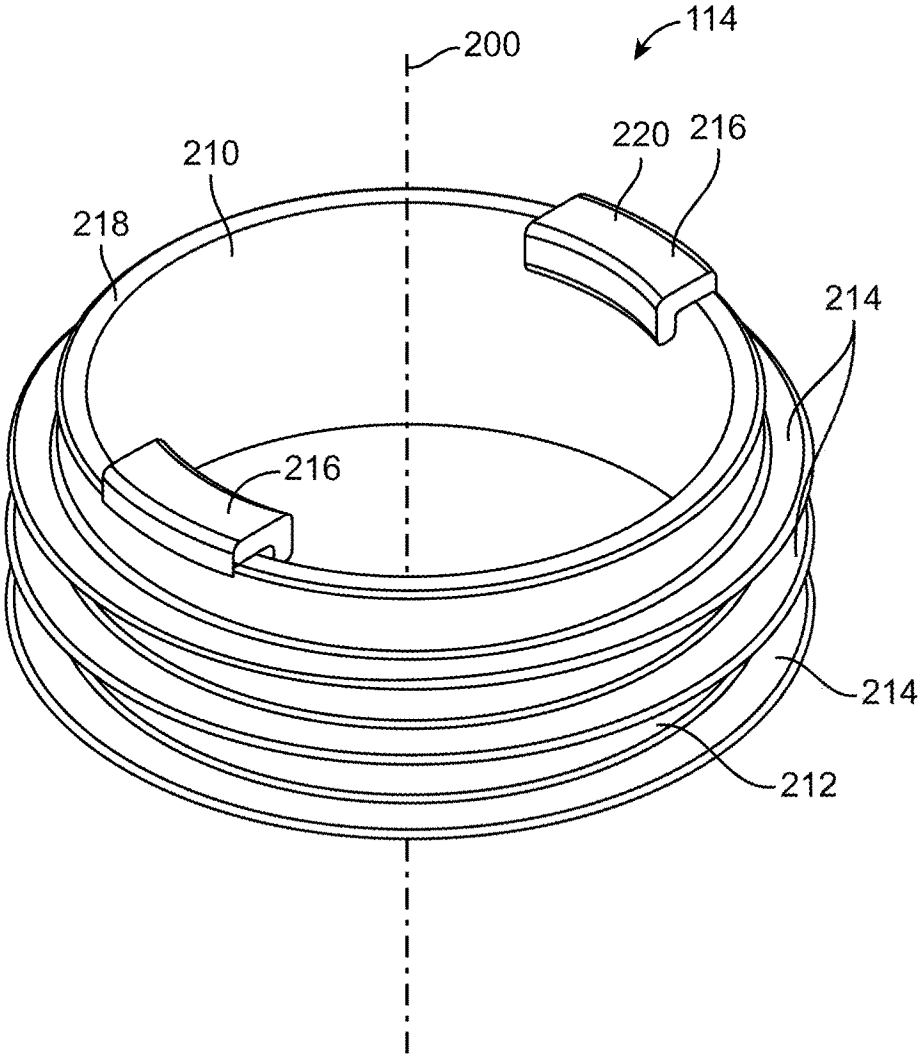
FIG. 14 is a perspective view of a gasket.

As shown, the central post 190 extends along the central axis 200 of the trap seal protection device 110, through in other embodiments, the central post 190 may be a post that is not centered with respect to the device 110. An upper end 194 of the central post 190 is located between the two wings 180 of the upper portion 162 of the housing 112 and a lower end 196 of the central post 190 is located within the fluid flow passage 166 of the lower portion 160 of the housing 112. As shown, the diameter of the passage through the central post 190 increases from the lower end 196 to the upper end 194, though in other embodiments, the diameter of the passage may be constant. The first and second ribs 192 function to locate and support the central post 190 within the remainder of the housing 112 and extend radially outward from the central post 190 to the lower and upper portions 160, 162. In some embodiments, the ribs 192 only extend between the central post 190 and only one of the lower portion 160 or the upper portion 162. As shown in FIG. 9, a lower end 196 of the central post 190 is shaped to support the seal member 116 as described in greater detail below.

A cap 202 is coupled to (e.g., rests on, extends over) the upper end 194 of the hollow central post 190 to prevent fluids flowing through the trap seal protection device 110 from flowing through the hollow central post 190. In some embodiments, the cap 202 is openable to allow for air to pass upwards from the drain assembly 120 through the central post 190. In other embodiments, the cap 202 includes openings that are air-permeable and always open. The openings may be covered by a fluid-resistant screen or may be oriented such that fluids within the trap seal protection device 110 are precluded from passing therethrough.

Figure 3:
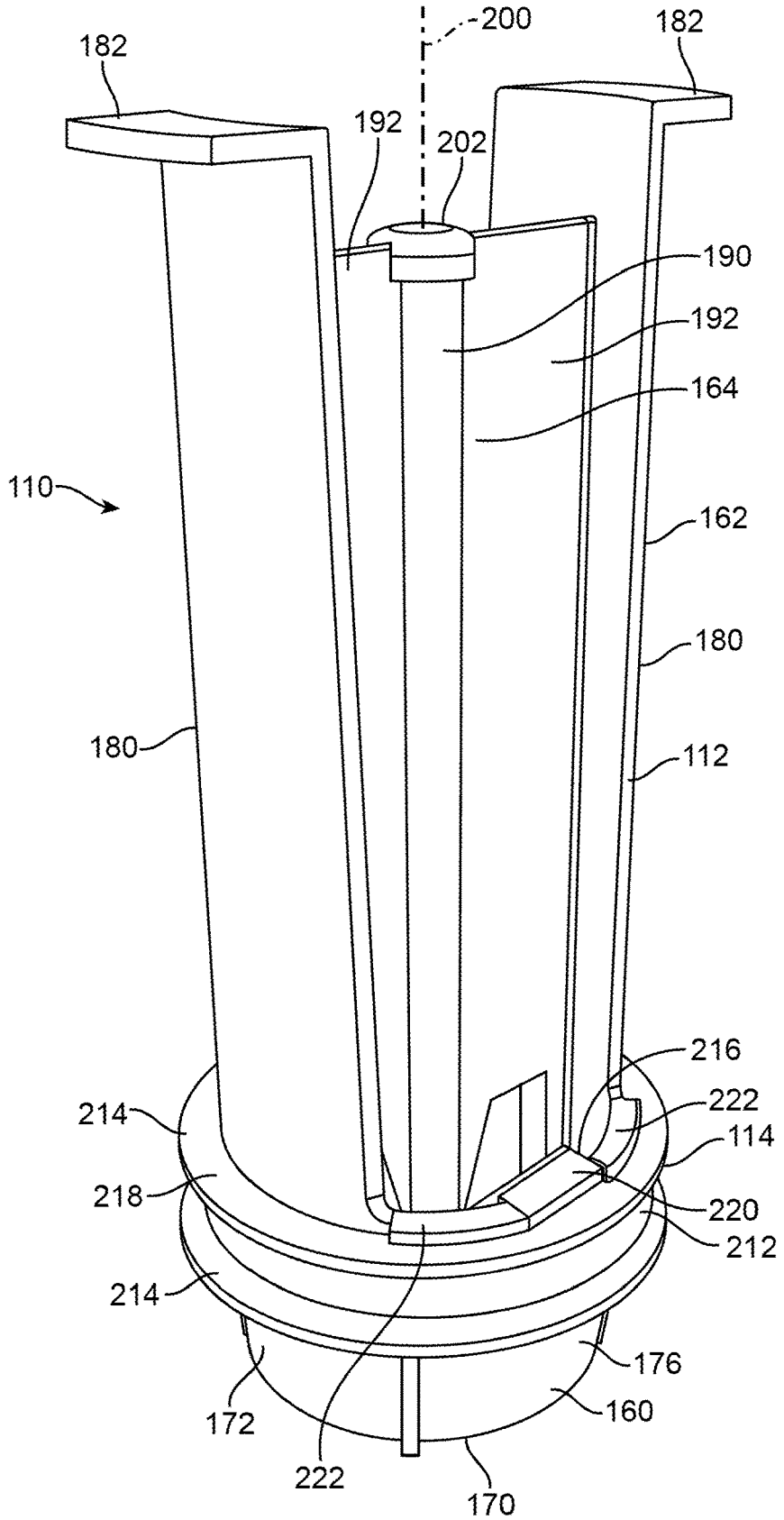
FIG. 3 is a first perspective view of the trap seal protection device of FIG. 2.

The gasket 114 is annular, is formed of a flexible material (e.g., a rubberized material), and extends around the lower portion 160 of the housing 112. More particularly the gasket 114 extends around and engages the gasket receiving surface 174 of the housing 112. The gasket 114 has an inner surface 210 (e.g., see FIG. 14) defining an inner diameter of the gasket 114 and an outer surface 212. A plurality of radial seals 214 may be positioned on the outer surface 212 and engage the cylindrical portion 124 of the drain assembly 120 to provide a fluid tight seal around the outside of the trap seal protection device 110 to prevent fluid from flowing around the outer diameter of the trap seal protection device 110. The inner surface 210 has a diameter similar to the diameter of the gasket receiving surface 174 to seal against the gasket receiving surface 174. The radial seals 214 extend radially outward from an otherwise generally cylindrical outer surface 212 and have a diameter sized to be slightly larger than an inner diameter of the cylindrical portion 124 of the drain assembly 120 such that the radial seals 214 elastically deflect against the cylindrical portion 124 drain assembly 120 to form a fluid-tight seal. As shown in FIGS. 2-3, in some embodiments, the gasket 114 includes two spaced apart radial seals, each having the same outer diameter. As shown in FIGS. 4-11 and 14, in other embodiments, the gasket 114 includes three spaced-apart radial seals 214, each having the same outer diameter. In other embodiments, more or fewer radial seals 214 may be utilized. By utilizing three radial seals 214 (as opposed to one or two radial seals), the radial seals 214 can be made less stiff to improve the case of installation.

The gasket 114 further includes an attachment structure 216 for coupling the gasket to the housing 112 and preventing relative rotation between the gasket 114 and the housing 112. As shown, the attachment structure 216 includes one or more (as shown, two) radial protrusions 220 extending radially inwards towards one another from an upper surface 218 of the gasket 114. As shown in detail in FIG. 14, the protrusions 220 are generally L-shaped protrusions extending radially inward and then axially downward into the cylindrical space within the inner surface 210. Each of the protrusions 220 is sized and shaped to engage the lower portion 160 of the housing 112 as shown in, for example, FIG. 3. The protrusions 220 prevent separation of the gasket 114 from the housing 112 when axially removing the trap seal protection device 110 from the drain assembly 120. Further, the lower portion 160 of the housing 112 includes protrusions 222 extending radially outward at a location above (e.g., directly above) the gasket receiving surface 174. The protrusions 222 engage a top surface of the gasket 114 when the gasket 114 is positioned on the gasket receiving surface 174 and prevent separation of the gasket 114 from the housing 112 when axially inserting the trap seal protection device 110 into the drain assembly 120. Further, the protrusions 222 surround and circumferentially abut the protrusions 220 of the gasket 114 to prevent relative rotation between the gasket 114 and the housing 112.

In some embodiments, such as shown in FIGS. 7A-11 and 14, the uppermost of the radial seals 214 is axially spaced apart from the protrusions 222 of the housing 112 such that when the radial seals 214 deflect upon insertion into the drain assembly 120, the protrusions 222 do not interfere with the seals 214. In some embodiments, this means that an axial gap is provided between the uppermost radial seal 214 and the protrusions 222 such that a maximum deflection of the uppermost radial seal 214 does not contact the protrusions 222. The axial gap may therefore be greater than the radial distance of the seal 214 from the cylindrical sidewall of the gasket 114.

Figure 4:
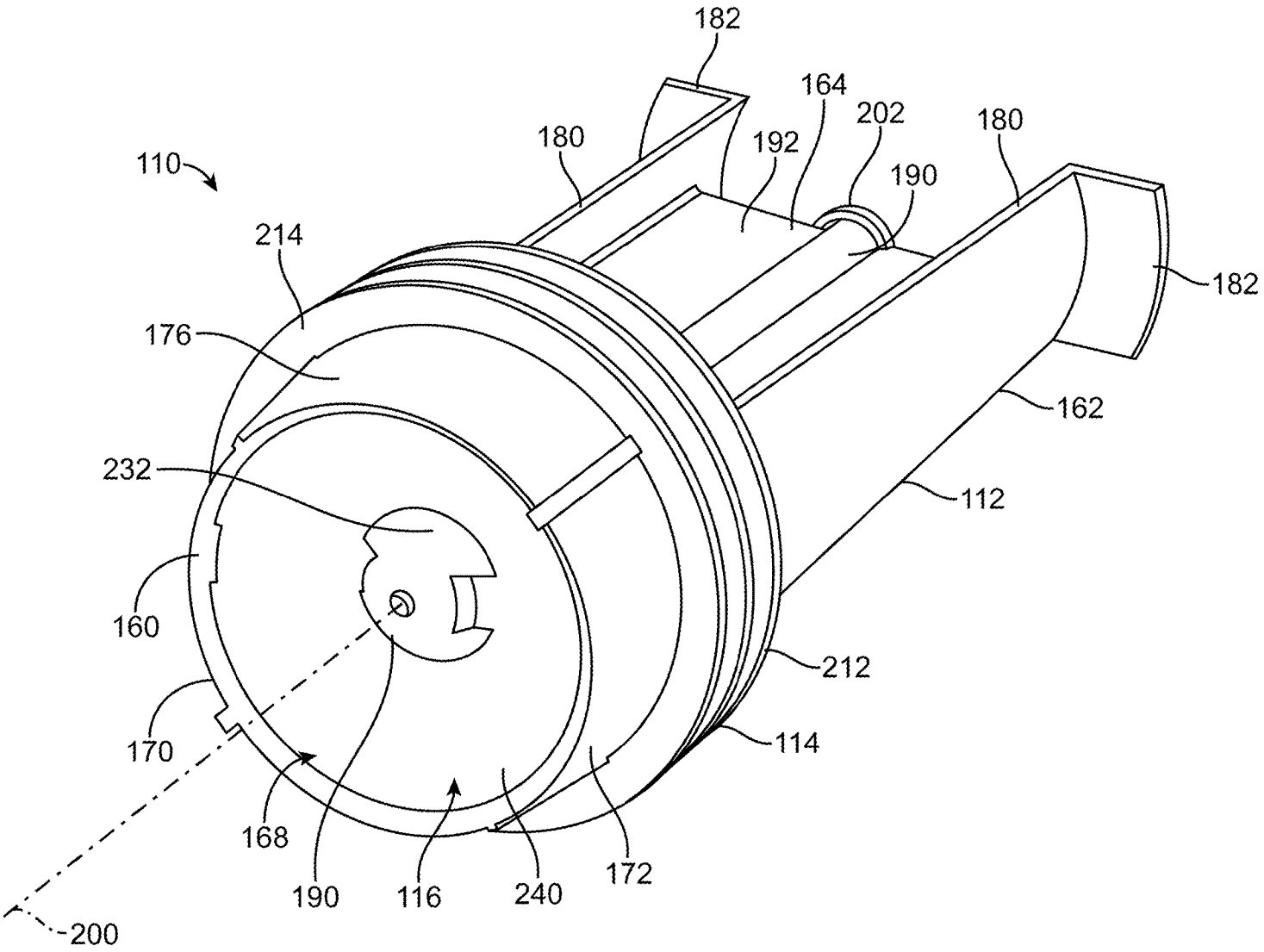
FIG. 4 is a second perspective view of the trap seal protection device of FIG. 2.
Figure 8:
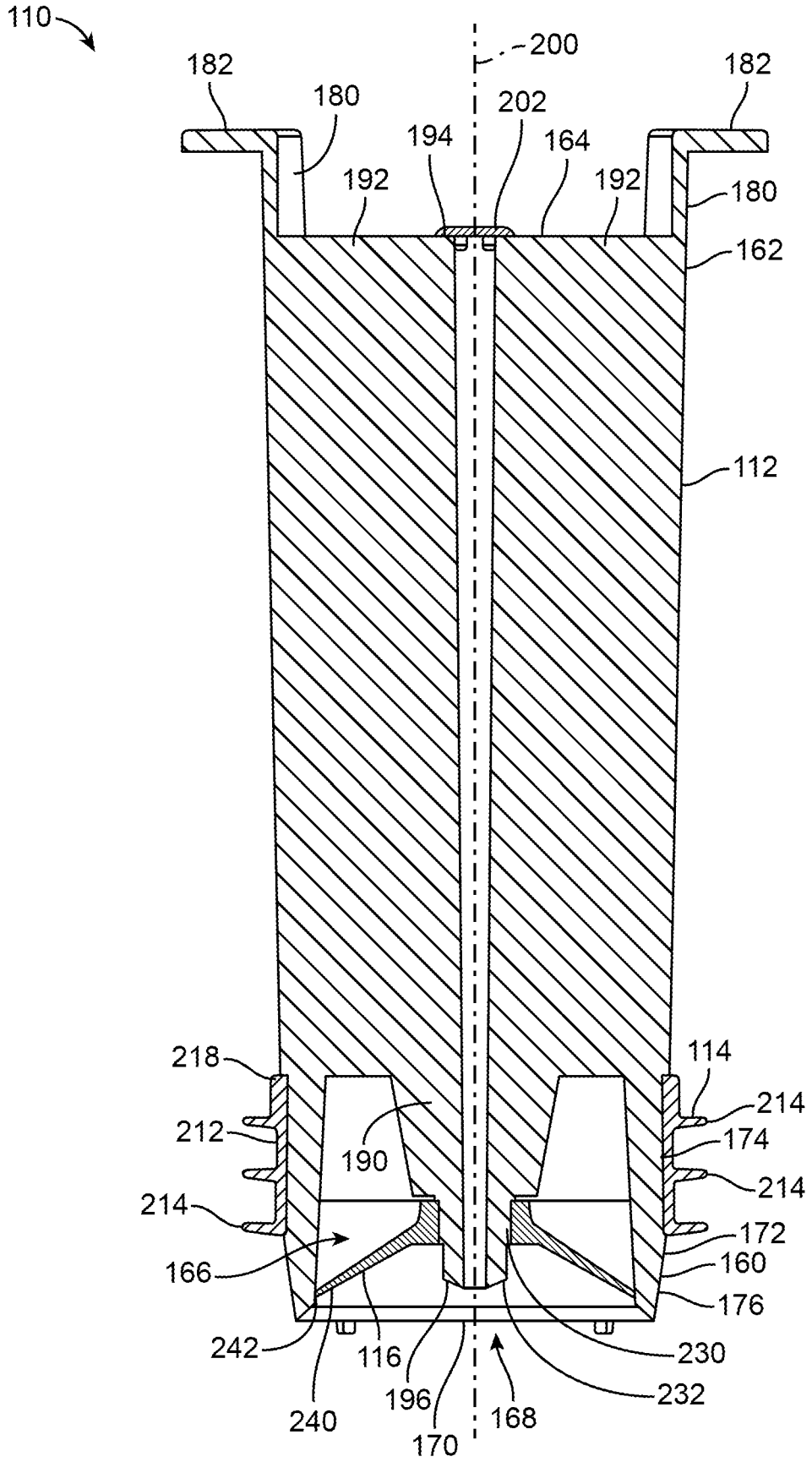
FIG. 8 is a cross-sectional view of the trap seal protection device of FIG. 2, viewed along section 8-8 as indicated in FIG. 7B.

As shown in greater detail in FIGS. 4, 8, 9, and 15, the seal member (also referred to as a flapper) 116 is made of a flexible material (e.g., a rubberized material) and is movable (e.g., elastically deformable) to permit fluid to pass through the trap seal protection device 110 when the pressure of the fluid upon the seal member 116 is sufficient to deform the seal member 116. The seal member 116 has a central opening 230 to surround and engage the lower end 196 of the central post 190 and mount thereto. As shown in FIGS. 4, 8, and 9, the lower end 196 of the central post 190 includes a sloped or ramped surface 232 having a maximum diameter greater than the diameter of the central opening 230 such that the seal member 116 is deformed to pass over the sloped or ramped surface 232 and into engagement with a radial seat 234.

The seal member 116 extends radially outward from the central opening 230, forming a generally conical surface 240 that also extends downwards towards the lowermost axial extent of the trap seal protection device 110. The seal member 116 also thins out from a maximum thickness adjacent the central opening 230 to a minimum thickness at the outer radial extents 242 of the seal member 116 to more easily deform at the outer radial extents 242. The maximum diameter of the seal member 116 is greater than the inner diameter of the housing 112 where the seal member 116 contacts the lower portion 160 of the housing 112 such that the seal member 116 deforms against the inner wall of the lower portion 160 to form a seal therebetween.

In operation, assembly of the trap seal protection device 110 within the drain assembly 120 includes removing the grate 150 and inserting the trap seal protection device 110 into the cylindrical portion 124 until the flanges 182 of the device 110 rest upon the flange 122 of the drain assembly 120. The grate 150 is then reinstalled. In use, with the trap seal protection device 110 installed within the drain assembly 120, water or other fluids drain through the grate 150 and into the body cavity 134 of the drain body 132. The gasket 114 prevents the fluid from bypassing the trap seal protection device 110 such that the fluid engages the upper surface of the seal member 116. When the pressure of the water built up on top of the seal member 116 reaches a predetermined threshold dependent upon the thickness and rigidity of the seal member 116, the seal member 116 elastically deforms downward at the outer radial extents of the seal member 116, introducing a fluid flow path through the trap seal protection device 110. Air within the drain assembly 120 below the trap seal protection device vents through the hollow central post 190.

The trap seal protection device 110 can have a significantly increased height compared to prior art trap seal protection devices. The trap seal protection device 110 extends adjacent to the grate 150 and finished floor 152 to rest on the flange 122 of the shallow drain assembly 120 while still locating the deformable seal member 116 at a substantial distance (e.g., at least 4 inches, at least 5 inches) below the grate 150 and finished floor 152 such that a sufficient amount of water is able to build up upon the seal member 116 to deform the seal member 116. If a typical prior art trap seal protection device were instead installed at the flange 122 of the shallow drain assembly 120, the pressure of the water upon the seal member would not be sufficient to deform the seal member. The trap seal protection device 110 is mounted at a sump depth of less than two inches (e.g., less than two inches, less than one inch, between ⅛ inch and 1 inch) below the finished floor 152 and yet due to the location of the seal member 116, is capable of a fluid throughput of at least 12 gallons/minute for at least ten minutes through the trap seal protection device 110 on a two-inch drainage pipe and at least 32 gallons per minute for at least ten minutes on a three-inch drainage pipe. The trap seal protection device 110 can be used with drain assemblies 120 and wastewater pipes having varying dimensions and thicknesses (e.g., schedule 10 pipe, schedule 40 pipe, etc.) while still allowing the seal member 116 to be located deep enough within the drain assembly 120 to allow for sufficient flow through the trap seal protection device 110 and such that the trap seal protection device 110 can properly mount to the drain assembly 120 without falling through or detaching from the drain assembly 120.

As shown, in order to provide a radial support surface for the trap seal protection device 110 within the drain assembly 120, an axial distance between the flange 182 and the seal member 116 is greater than the outer diameter of the gasket 114. In some embodiments, the overall height (i.e., axial length) of the trap seal protection device 110 is at least four inches (e.g., at least four inches, at least five inches, four to seven inches) such that the distance between the flanges 182 and the outer radial edge of the seal member 116 is likewise roughly at least four inches (e.g., at least four inches, at least five inches, four to seven inches).

By resting upon the flange 122 of the drain assembly 120, the flanges 182 of the trap seal protection device 110 form a circumferential lip. If the distinct and separate flanges 182 of the trap seal protection device 110 were instead formed as a fully annular flange, the circumferential lip would form a recess below the grate 150 and between the flange 182 of the device 110, the flange 122 of the drain assembly 120, and the frame assembly 140. Fluid falling through the grate 150 into such a recess would be effectively trapped within the recess, resulting in standing water. In contrast, the distinct and separate flanges 182 permit fluid atop the flange 122 of the drain assembly 120 to drain into the trap seal protection device 110 via the gaps between the flanges 182. Additionally, the distinct and separate flanges 182 and wings 180 of the device 110 take up less space within the drain assembly 120 than a fully cylindrical sidewall. As such, the height of water necessary to unseal the seal member 116 is reduced such that the overall height of the trap seal protection device 110 is reduced.

The trap seal protection device 110 prevents evaporation of the water/fluid within the drain below the trap seal protection device 110, which reduces odors emitting from the drain, while still permitting the flow of water downwardly through the drain. Additionally, it may prevent gas from an attached drain or sewer line from passing upwardly through the drain opening and into the room. Further, in some embodiments, the trap seal protection device may be utilized as a backflow prevention device. The trap seal protection device 110 has a low profile and therefore prevents splash back of water within the drain assembly 120, which is desirable in hospitals and other sanitary environments.

Figure 6:
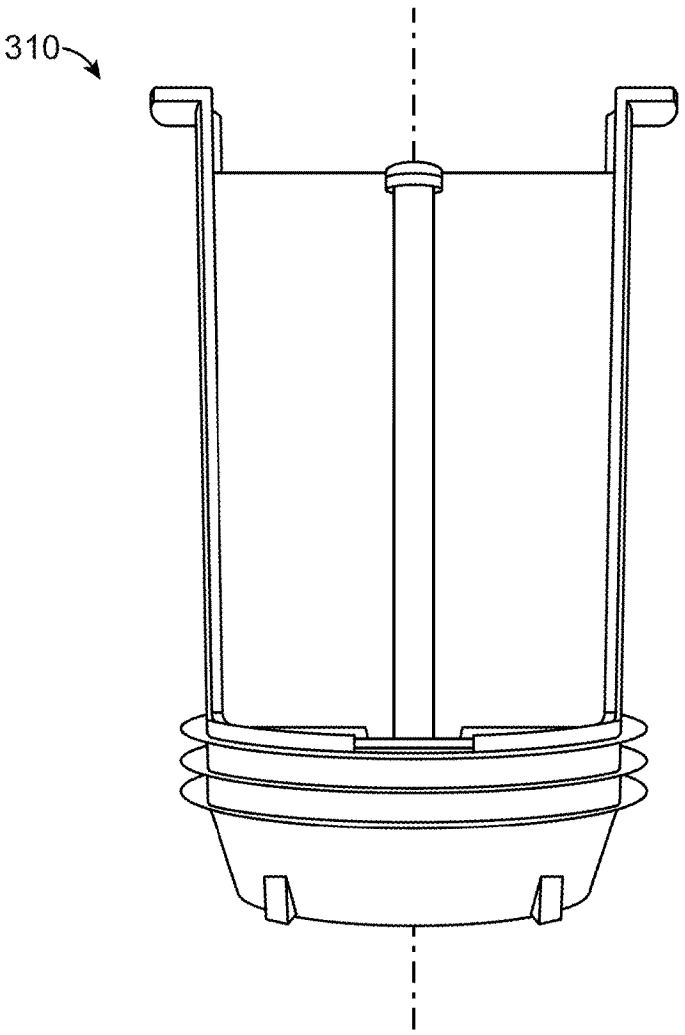
FIG. 6 is a front view of a trap seal protection device according to another embodiment.
Figure 5:
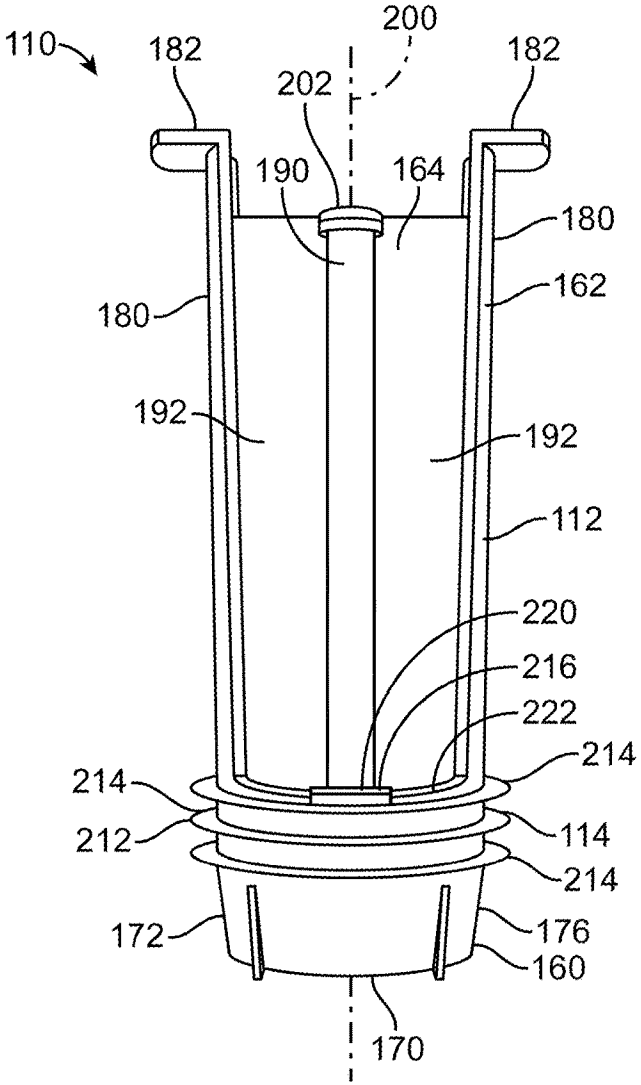
FIG. 5 is a front view of the trap seal protection device of FIG. 2.

FIG. 5 illustrates the trap seal protection device 110. FIG. 6 illustrates a trap seal protection device 310 similar to the trap seal protection device 110, though sized to engage a drain assembly of a larger diameter. For example, the trap seal protection device 110 may be sized to engage and seal within a drain assembly having a two-inch diameter. In other embodiments, the trap seal protection device may be sized to engage and seal within a drain assembly having a different diameter (e.g., a three-inch drain assembly (FIG. 6), a four-inch drain assembly, etc.). A trap seal protection device sized to engage and seal within a larger diameter drain assembly may have a similar (or in some embodiments shorter) axial height than a trap seal protection device sized to engage and seal within a drain assembly having a four-inch or larger inner diameter.

It will be understood that certain features and sub combinations are of utility and may be employed without reference to other features and sub combinations. Features described and illustrated with respect to certain embodiments may also be implemented in other embodiments. This is contemplated by and is within the scope of the claims. Since other possible embodiments of the disclosure may be made without departing from the scope thereof, it is understood that examples herein described or shown in the accompanying drawings are to be interpreted as illustrative and are not intended to limit the concepts and principles of the present disclosure. Many changes, modifications, variations and other uses and applications of the illustrated examples will become apparent to those skilled in the art after considering the specification and the accompanying drawings. Such changes, modifications, variations and other uses and applications are deemed to be covered by the disclosure.

What is claimed is:

1. A trap seal protection device for a drain assembly having a drain body, the trap seal protection device comprising:

a housing including a flange configured to engage a surface of the drain assembly to support the housing relative to the drain assembly;

a gasket supported by the housing, the gasket having an outer diameter and configured to engage an inner surface of the drain body; and a seal member supported by the housing and selectively sealing a fluid passageway, the seal member being selectively movable between an open configuration wherein the seal member permits fluid to flow past the seal member and a closed configuration wherein the seal member blocks fluid flow past the seal member, an axial distance between the flange and an upper end of the seal member in the closed configuration being greater than the outer diameter of the gasket.

2. The trap seal protection device of claim 1, wherein the gasket includes a protrusion that extends radially inwardly from an upper surface of the gasket, and wherein the protrusion engages the housing and prevents movement of the gasket relative to the housing.

3. The trap seal protection device of claim 1, wherein an outer surface of the housing includes a protrusion engaging a portion of the gasket, engagement of the gasket by the protrusion preventing movement of the gasket relative to the housing.

4. The trap seal protection device of claim 1, wherein the gasket includes a gasket protrusion that extends radially inwardly from an upper surface of the gasket, wherein the housing includes a first housing protrusion and a second housing protrusion, each of the first housing protrusion extending radially outwardly from an outer surface of the housing, the gasket protrusion positioned between the first housing protrusion and the second housing protrusion.

5. The trap seal protection device of claim 4, wherein the gasket protrusion abuts the first housing protrusion and the second housing protrusion to prevent movement of the gasket relative to the housing.

6. The trap seal protection device of claim 1, wherein an upper portion of the housing is positioned upstream of the seal member in a direction of fluid flow through the drain assembly.

7. The trap seal protection device of claim 1, wherein the housing includes a first outer wing and a second outer wing, the first outer wing and the second outer wing spaced apart from one another by an open space.

8. The trap seal protection device of claim 1, wherein a lower portion of the housing has a tapered outer surface, and wherein an upper portion of the housing has a substantially consistent outer width along a longitudinal axis of the housing.

9. The trap seal protection device of claim 1, further comprising:

a post that extends in an axial direction from an upper end of the housing to a lower end of the housing, the post including a hollow tube portion extending an entire length of the post to provide a vent path from the lower end of the housing to the upper end of the housing; and a cap coupled to an upper end of the post to prevent fluids from entering the hollow tube portion while allowing air to escape the hollow tube portion at the upper end of the post.

10. A trap seal protection device for a drain assembly, the trap seal protection device comprising:

a housing including a downstream portion and an upstream portion, the upstream portion including a plurality of wings, each one of the plurality of wings including a distal end and a bearing surface positioned adjacent the distal end, the bearing surface protruding radially outward from the housing and configured to engage a surface of the drain assembly; and a gasket supported by the housing, the gasket having an outer diameter and configured to engage an inner surface of the drain assembly, an axial distance between the bearing surface of one of the plurality of wings and the gasket being greater than the outer diameter of the gasket.

11. The trap seal protection device of claim 10, further comprising a post that extends in an axial direction from an upper end of the housing to a lower end of the housing, wherein a rib extends radially between the central post and at least one of the plurality of wings.

12. The trap seal protection device of claim 11, further comprising a seal member engaging and providing a water-tight seal between an outer surface of the post and an inner surface of the housing.

13. The trap seal protection device of claim 11, wherein the post includes a hollow tube portion extending an entire length of the post to provide a vent path from the lower end of the housing to the upper end of the housing.

14. The trap seal protection device of claim 13, wherein the hollow tube portion has a diameter that increases as the hollow tube portion extends from a lower end of the post to an upper end of the post.

15. The trap seal protection device of claim 13, further comprising a seal member supported by the housing and selectively sealing a fluid passageway, the seal member being selectively movable to permit fluid to flow past the seal member, an axial distance between the upper end of the housing and the seal member being greater than an outer diameter of the gasket.

16. The trap seal protection device of claim 13, further comprising a cap coupled to an upper end of the post to prevent fluids from entering the hollow tube portion while allowing air to escape the hollow tube portion at the upper end of the post.

17. The trap seal protection device of claim 10, wherein the gasket includes a protrusion that extends radially inwardly from an upper surface of the gasket, the protrusion engaging the housing and preventing movement of the gasket relative to the housing.

18. A drain assembly, the drain assembly comprising:

a main body;

a grate supported relative to the main body and covering an inlet;

a radial surface extending from an upper end of the main body, the radial surface positioned less than two inches below the grate; and a trap seal protection device including, a housing including a flange engaging the radial surface to support the housing relative to the main body, a gasket coupled to the housing, the gasket having an outer diameter engaging an inner surface of the main body, and a seal member supported by the housing and selectively sealing a fluid passageway, the seal member being selectively movable to permit fluid to flow past the seal member.

19. The drain assembly of claim 18, wherein an axial distance between the flange and the seal member is greater than the outer diameter of the gasket.

20. The drain assembly of claim 18, wherein an upper end of the seal member is positioned at least 4 inches below the grate.

21. The drain assembly of claim 18, wherein the main body has a substantially cylindrical shape, the main body having a diameter that is substantially equal to a pipe diameter of a wastewater pipe coupled to a downstream end of the drain assembly.

22. The drain assembly of claim 18, further comprising:

a post that extends in an axial direction from an upper end of the housing to a lower end of the housing, the post including a hollow tube portion extending an entire length of the post to provide a vent path from the lower end of the housing to the upper end of the housing; and a cap coupled to an upper end of the post to prevent fluids from entering the hollow tube portion while allowing air to escape the hollow tube portion at the upper end of the post.

* * * * *